United States Patent [19]

Ahlschlager et al.

[11] 4,176,698

[45] Dec. 4, 1979

[54] FIREWOOD SPLITTING DEVICE

[76] Inventors: Christ L. Ahlschlager, Minneota, Minn. 56264; Marvin L. Ahlschlager, Iona, Minn. 56141; Donald A. Ahlschlager, Balaton, Minn. 56115

[21] Appl. No.: 914,670

[22] Filed: Jun. 9, 1978

[51] Int. Cl.[2] ..... B27L 7/00

[52] U.S. Cl. ..... 144/193 R; 83/78; 144/323

[58] Field of Search ..... 144/3 K, 193 R, 323, 144/193 A, 326 R; 83/78

[56] References Cited

U.S. PATENT DOCUMENTS

| | | | |
|---|---|---|---|
| 262,591 | 8/1882 | Hildreth | 144/193 R |
| 401,866 | 4/1889 | Stearns | 144/193 R |
| 470,104 | 3/1892 | Dante | 144/193 R |
| 3,356,115 | 12/1967 | Cole | 144/193 R |
| 4,116,251 | 9/1978 | Graney | 144/193 R |

*Primary Examiner*—Robert L. Spruill
*Assistant Examiner*—W. D. Bray

[57] ABSTRACT

A firewood splitting device comprising a holder for the log and a ram having a wedge-shaped end. The ram is mechanically driven by a small power unit turning a large flywheel and using the inertia of the flywheel to power the wedge. The device also uses a sliding plate on which the ram is mounted to form a shear with a wall of the device for shearing small branches.

3 Claims, 4 Drawing Figures

FIREWOOD SPLITTING DEVICE

BACKGROUND AND SUMMARY OF THE INVENTION

With the current increase in interest in wood burning equipment to alleviate the impact of the energy shortage, means for splitting logs to provide firewood is also in increased interest.

Past practice has been mostly manual. Logs were sawed to stove length and then split by use of an ax or a maul and one or more wedges. This practice made good exercise, but is neither very fast nor very efficient.

Powered devices have generally attempted simply to duplicate the use of a maul and wedges. Nearly all have used a vertical stroke of a hammer type device to drive a wedge into the section of log being split and have been relatively clumsy.

Among the powered devices currently in use are hydraulic ram type devices having a single stroke. These require an operator to move controls for each stroke, and therefore require resetting of the block to be split each time. With our device, we use a continuous stroke. The operator then can keep close to the block being split, and can in fact simply grasp the block and turn it to a new position after each stroke. The result is a much faster operation.

By our invention we thus provide a compact and efficient device to split the wood. We can use a relatively small engine for power and by use of a large flywheel still provide a large driving force to drive the wedge into the block. The device is also usable to shear long pieces of wood laterally thus breaking longer pieces into pieces of fireplace length or the like.

FIGURES

DESCRIPTION

Figure 1:
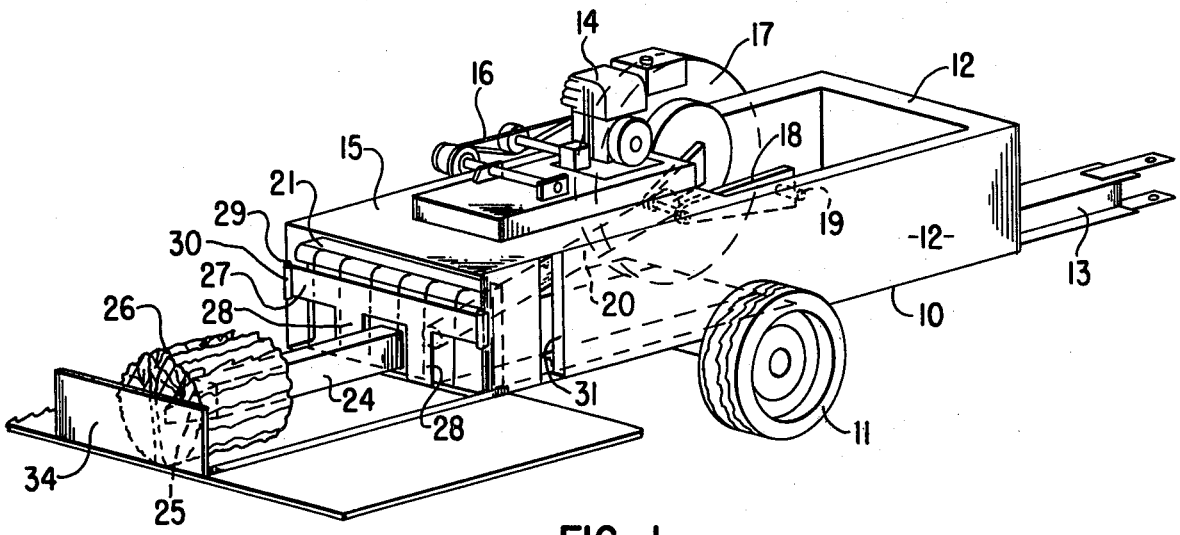
FIG. 1 is a pictorial view of the device.
Figure 2:
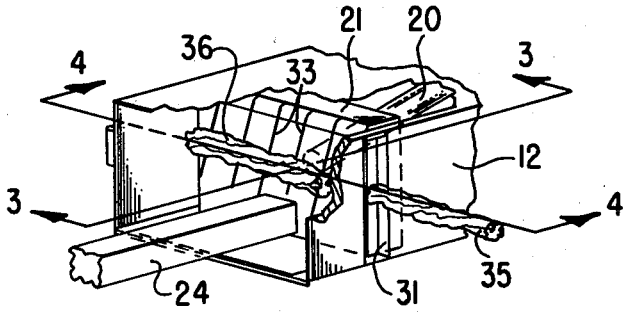
FIG. 2 is a detailed pictorial view of the working portion of the device.
Figure 3:
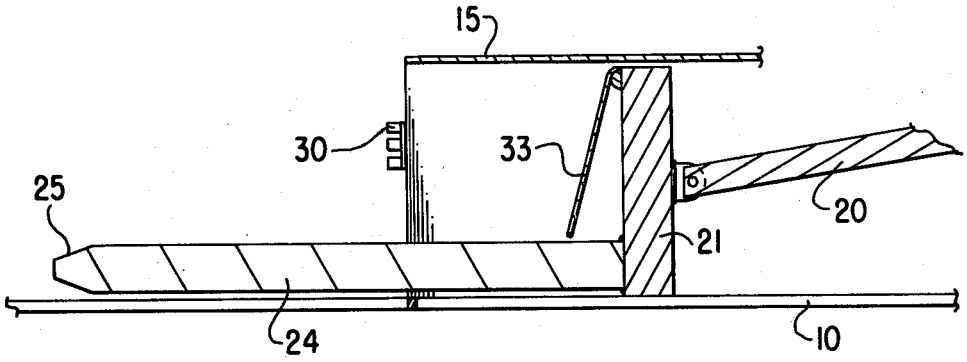
FIG. 3 is a sectional view from line 3—3 of FIG. 2.
Figure 4:
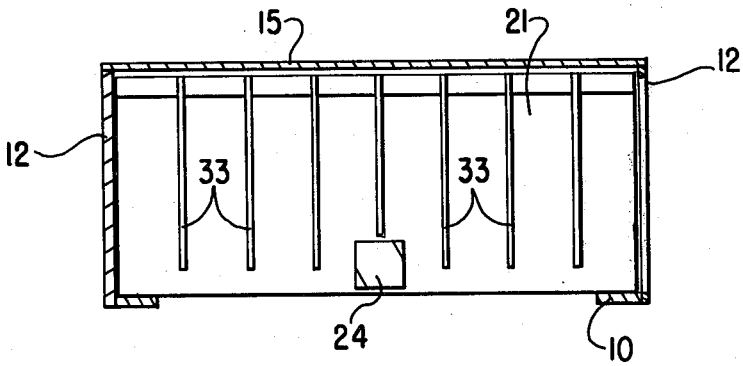
FIG. 4 is a sectional view from line 4—4 of FIG. 2.

Briefly our invention comprises a device powered by a relatively small engine for splitting logs for use as fuel. The device includes a horizontally sliding ram having a wedge-shaped point. The point is adapted to hit the end of a log placed on a holder and to split the log. Energy stored in a flywheel creates substantial force to drive the wedge. Means is also provided to strip the log from the wedge if the log is incompletely split.

More specifically and referring to the drawings, we prefer a portable device and therefore we mount our device on a platform 10 mounted on wheels 11. Walls 12 of relatively heavy material are mounted on the platform 10 and serve to support the operating mechanism. A tongue 13 is provided so that the device may be easily towed to various locations.

The operating mechanism includes a relatively small engine or motor 14. We have illustrated a small internal combustion engine, but it will be obvious that an electric motor or other suitable power source could be used. The motor is mounted on a cover 15 supported by the walls 12.

Power is transmitted from the engine 14 through a belt system 16 to a large heavy flywheel 17. This flywheel is mounted on a shaft journalled in the walls 12 and drives a crank 18 fixed to the flywheel shaft at one end and having a stub shaft 19 at the other end also journalled in a wall 12. The crank 18 drives a pitman 20 journalled at one end on the crank, and at the other pivotally attached to a heavy plate 21.

The plate 21 is slidably mounted between the walls 12 and on the platform 10 so that operation of the crank causes longitudinal oscillation of the plate. The crank is proportioned so that the stroke is relatively long, and the drive is arranged so that the oscillations are fairly slow.

A ram 24 is fixed to the plate 21 at its face opposite the connection with the pitman 20. The ram may preferably be located so as to slide on the platform, or at least is mounted near the lower edge of the plate 21. The tip 25 of the ram 24 is formed with a wedge shape having a vertical edge. Thus, a log 26 lying on the platform with the grain running generally longitudinally of the stroke of the ram will be engaged by the tip 25 of the ram and be readily split by the wedge. Because the ram is located near the bottom of the plate 21, almost any size log can be split by this means. A stop board 34 is used to hold the log in place while the ram splits it.

Various refinements are also provided. In order to be sure a partially split log does not become stuck on the end of the ram 24, we provide a stripper plate 27. This plate is essentially a bar extending between the walls 12 and having depending legs 28 on both sides of the ram 24. The plate is preferably removably attached to the walls 12 by hinge pins 29 extending through ears 30 or the like so that the device may be used for an alternative use.

The alternative use is for the shearing of small tree branches, and uses the same power mechanism. One wall 12 is formed to provide a slot 31 through which small branches may be inserted. This slot is positioned so that the outer face of the plate 21 when moved by the crank 18, completely moves past the slot 31. The plate, being slidably mounted between the walls 12 is of such dimensions that it slides fairly closely to those walls. Thus, the front edge of the plate 21 will form a shear with the edges of the slot 31. Insertion of a small branch or twig 35 into the slot while the machine is running will thus cause the twig to be sheared off by the movement of the plate 21 past the slot 31. We prefer that only one wall have a slot. The opposite wall may be used as a stop by which the length of the sheared piece 36 of branch may be gauged.

In order to facilitate clearing of the machine when used as a shear, we provide a series of heavy spring fingers 33 mounted on the plate 21. These fingers extend from the top of that plate downwardly and outwardly from the upper edge of the plate 21. As the shearing action between the plate 21 and the edge of the slot 31 starts, the fingers 33 are pressed against the branch being sheared, thus storing up energy. As the shearing action is completed, the fingers tend to spring outwardly, thus throwing the sheared piece outwardly of the device.

It will be apparent that the relatively large amounts of energy required either to shear a small branch or to split a large log can be stored up in the inertia of the large flywheel 17 so that the wedge can be completely driven into the log or the branch fully sheared, while using only a relatively small engine.

We claim:

1. A device for splitting logs comprising platform means on which a log may be held, sidewalls mounted vertically on each lateral side of said platform, plate means slidably disposed on said platform between said walls, crank means rotatably mounted above said platform, pitman means operably connecting said crank means and said plate means, power means including a large flywheel on said crank means adapted to drive said plate means, ram means mounted on said plate means on a face opposite said crank means, and a stripper plate mounted between said walls and adjacent said ram means.

2. The device of claim 1 in which one wall is formed to provide a slot, said slot being located so that the plate means slides past it during each reciprocation, one edge of said plate means and one edge of said slot thus cooperating to act as a shear for material inserted into said slot.

3. The device of claim 2 in which said plate means carries spring fingers spaced from its face opposite the pitman, said fingers being positioned to engage material inserted into said slot, said fingers being compressible into the spacing between them and said face and adapted to spring away from said face when the compressing force is released.

* * * * *